US009395112B2

(12) United States Patent
Prins

(10) Patent No.: US 9,395,112 B2
(45) Date of Patent: Jul. 19, 2016

(54) METHOD FOR CONTROLLING OPERATION OF A VAPOUR COMPRESSION SYSTEM IN A SUBCRITICAL AND A SUPERCRITICAL MODE

(75) Inventor: Jan Prins, Nordborg (DK)

(73) Assignee: Danfoss A/S, Nordborg (DK)

( * ) Notice: Subject to any disclaimer, the term of this patent is extended or adjusted under 35 U.S.C. 154(b) by 389 days.

(21) Appl. No.: 14/128,271

(22) PCT Filed: Jul. 3, 2012

(86) PCT No.: PCT/DK2012/000079

§ 371 (c)(1),
(2), (4) Date: Dec. 20, 2013

(87) PCT Pub. No.: WO2013/004233

PCT Pub. Date: Jan. 10, 2013

(65) Prior Publication Data

US 2014/0116075 A1 May 1, 2014

(30) Foreign Application Priority Data

Jul. 5, 2011 (DK) ..... 2011 00513

(51) Int. Cl.
*F25B 49/00* (2006.01)
*F25B 49/02* (2006.01)
*F25B 9/00* (2006.01)

(52) U.S. Cl.
CPC ..... *F25B 49/022* (2013.01); *F25B 9/008* (2013.01); *F25B 49/02* (2013.01);
(Continued)

(58) Field of Classification Search
CPC ..... F25B 49/00; F25B 49/02; F25B 49/022; F25B 49/027; F25B 9/008
See application file for complete search history.

(56) References Cited

U.S. PATENT DOCUMENTS 6,298,674 B1 10/2001 Finkenberger et al.
2003/0115896 A1 * 6/2003 Caesar ..... B60H 1/3208 62/228.3

FOREIGN PATENT DOCUMENTS

CN 101124439 A 2/2008
DE 195 22 884 A1 1/1997
(Continued)

OTHER PUBLICATIONS

International Search Report for PCT Serial No. PCT/DK2012/00079 dated Sep. 27, 2012.
(Continued)

*Primary Examiner* — Cassey D Bauer
*Assistant Examiner* — Antonio R Febles
(74) *Attorney, Agent, or Firm* — McCormick, Paulding & Huber LLP

(57) ABSTRACT

A method for controlling operation of a vapor compression system (1), and a vapor compression system (1) are disclosed. The vapor compression system (1) comprises a compressor (2), a heat rejecting heat exchanger (3), a controllable valve (4), a receiver (5), at least one expansion device and at least one evaporator arranged along a refrigerant path having refrigerant flowing therein. The vapor compression system (1) is capable of being operated in a subcritical control regime as well as in a supercritical control regime.

The method comprises the steps of measuring a temperature, $T_{GC}$, of refrigerant leaving the heat rejecting heat exchanger; calculating a pressure reference, $P_{GC, Ref}$, based on the measured temperature, $T_{GC}$, and using a calculation formula being applicable to the subcritical control regime as well as to the supercritical control regime; and controlling an opening degree of the controllable valve in order to obtain a pressure of refrigerant leaving the heat rejecting heat exchanger which is equal to the calculated pressure reference, $P_{GC, Ref}$.

Since the calculation formula is applicable to the subcritical control regime as well as to the supercritical control regime, only one calculation formula is necessary, and the vapor compression system (1) can thereby be controlled in a very easy manner.

18 Claims, 4 Drawing Sheets

(52) U.S. Cl.
CPC .. *F25B 2309/061* (2013.01); *F25B 2341/0662* (2013.01); *F25B 2400/13* (2013.01); *F25B 2400/16* (2013.01); *F25B 2500/19* (2013.01); *F25B 2600/17* (2013.01); *F25B 2600/2503* (2013.01); *F25B 2700/21163* (2013.01)

(56) References Cited

FOREIGN PATENT DOCUMENTS

| | | | | | |
|---|---|---|---|---|---|
| DE | 102007025319 | | * | 12/2008 | ..... F25B 9/008 |
| EP | 1 207 359 | A2 | | 5/2002 | |
| EP | 1 818 627 | A1 | | 8/2007 | |
| EP | 2 107 322 | A2 | | 10/2009 | |
| WO | 2004057246 | A1 | | 7/2004 | |
| WO | 2006/087005 | A1 | | 8/2006 | |
| WO | WO 2008032568 | A1 | * | 3/2008 | ..... F25B 9/008 |
| WO | WO 2010039630 | A2 | * | 4/2010 | ..... F25B 9/008 |

OTHER PUBLICATIONS

Danish Search Report Serial No. PA201100513 dated Jan. 19, 2012.

* cited by examiner

METHOD FOR CONTROLLING OPERATION OF A VAPOUR COMPRESSION SYSTEM IN A SUBCRITICAL AND A SUPERCRITICAL MODE

CROSS REFERENCE TO RELATED APPLICATIONS

This application is entitled to the benefit of and incorporates by reference subject matter disclosed in International Patent Application No. PCT/DK2012/000079 filed on Jul. 3, 2012 and Danish Patent Application No. PA 2011 00513 filed Jul. 5, 2011.

FIELD OF THE INVENTION

The present invention relates to a method for controlling a vapour compression system. According to the method of the invention, the vapour compression system can be operated in a subcritical control regime as well as in a supercritical control regime, using only one calculation formula for calculating a pressure reference. The present invention further relates to a control system for controlling a vapour compression system in accordance with the method, and to a vapour compression system comprising such a control system.

BACKGROUND OF THE INVENTION

Some vapour compression systems, such as refrigeration systems, heat pumps or air condition systems, are capable of operating in a subcritical control regime as well as in a supercritical control regime. Refrigerant flowing in the vapour compression system is compressed in a compressor and subsequently supplied to a heat rejecting heat exchanger. When the vapour compression system is operating in a subcritical control regime, the heat rejecting heat exchanger operates as a condenser, i.e. the compressed refrigerant is condensed while passing through the heat rejecting heat exchanger, and the refrigerant leaving the heat rejecting heat exchanger is therefore at least partly in a liquid state. On the other hand, when the vapour compression system is operating in a supercritical control regime, a phase transition of the refrigerant does not take place in the heat rejecting heat exchanger. Thus, in this case, the heat rejecting heat exchanger operates as a gas cooler, and the refrigerant leaving the heat rejecting heat exchanger is in a gaseous state.

Normally, one control strategy is used for the subcritical control regime, and a different control strategy is used for the supercritical control regime. This requires that the system is capable of keeping track of whether the vapour compression system operates in the subcritical or the supercritical regime. Furthermore, care must be taken when the vapour compression system is operated in the region close to the transitional point between the subcritical regime and the supercritical regime.

WO 2006/087005 A1 discloses a method for controlling an intermittently supercritically operating refrigeration circuit. In the subcritical mode a control valve is controlled so that a predetermined "subcritical pressure" ensuring a predetermined subcooling of the liquid refrigerant at the outlet of the heat rejecting heat exchanger is maintained. In the supercritical mode the control valve is controlled so that a predetermined "supercritical pressure", which is optimized for optimum efficiency of the supercritical refrigerant at the outlet of the heat rejecting heat exchanger is maintained. In a border mode, in a region next to the critical point, the control valve is controlled dependent on a "continuity pressure" which is determined on the basis of the predetermined "subcritical pressure" and "supercritical pressure". Thus, the refrigeration circuit is controlled according to three different control strategies.

SUMMARY

It is an object of embodiments of the invention to provide a method for controlling operation of a vapour compression system, the method allowing the vapour compression system to be easily controlled in a subcritical control regime as well as in a supercritical control regime.

It is a further object of embodiments of the invention to provide a method for controlling a vapour compression system, the method allowing the vapour compression system to be controlled in a subcritical control regime and in a supercritical control regime, using the same control formula.

It is an even further object of embodiments of the invention to provide a control system for controlling operation of a vapour compression system, the control system being capable of controlling the vapour compression system in a subcritical control regime as well as in a supercritical control regime in an easy manner.

It is an even further object of embodiments of the invention to provide a control system for controlling operation of a vapour compression system, the control system being capable of controlling the vapour compression system in a subcritical control regime as well as in a supercritical control regime, using the same control formula.

According to a first aspect, the invention provides a method for controlling operation of a vapour compression system, the vapour compression system comprising a compressor, a heat rejecting heat exchanger, a controllable valve, a receiver, at least one expansion device and at least one evaporator arranged along a refrigerant path having refrigerant flowing therein, the vapour compression system being capable of being operated in a subcritical control regime as well as in a supercritical control regime, the method comprising the steps of:

- measuring a temperature, $T_{GC}$, of refrigerant leaving the heat rejecting heat exchanger,
- calculating a pressure reference, $P_{GC,\ Ref}$, based on the measured temperature, $T_{GC}$, and using a calculation formula being applicable to the subcritical control regime as well as to the supercritical control regime, and
- controlling an opening degree of the controllable valve in order to obtain a pressure of refrigerant leaving the heat rejecting heat exchanger which is equal to the calculated pressure reference, $P_{GC,\ Ref}$.

In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc. The vapour compression system, thus, comprises a compressor, a heat rejecting heat exchanger, at least one expansion device, e.g. in the form of expansion valve(s), and at least one evaporator, arranged along a refrigerant path. The vapour compression system being controlled in accordance with the method according to the first aspect of the invention further comprises a controllable valve and a receiver, the controllable valve being arranged in the refrigerant path between the heat rejecting heat exchanger and the receiver. Thereby the opening degree of the controllable valve determines the pressure of the refrigerant leaving the heat rejecting heat exchanger. At the receiver, the liquid part of the refrigerant may be separated from the gaseous part of the refrigerant. In this case, the liquid part of the refrigerant is supplied to the low pressure side of the vapour compression system, i.e. it is supplied to the expansion device(s), where it is expanded before entering the evaporator(s), and the gaseous part of the refrigerant is supplied directly to the compressor, via a valve. Alternatively or additionally, the receiver may be provided with a heat exchanger which ensures that the gaseous part of the refrigerant is at least partly condensed in the receiver. The condensed refrigerant can then be supplied to the low pressure side of the refrigeration system as described above.

The vapour compression system is capable of being operated in a subcritical control regime as well as in a supercritical control regime. When operating in the subcritical control regime, the operating cycle of the refrigerant is such that, when passing through the heat rejecting heat exchanger, the refrigerant undergoes a phase transition, i.e. the refrigerant is at least partly condensed. On the other hand, when operating in the supercritical control regime, the operating cycle of the refrigerant is such that no phase transition takes place when the refrigerant passes through the heat rejecting heat exchanger, the refrigerant leaving the heat rejecting heat exchanger thereby being substantially in a gaseous phase. The vapour compression system, and the refrigerant flowing therein, is of a kind which sometimes operates in the subcritical control regime, and sometimes in the supercritical control regime.

According to the method of the first aspect of the invention, a temperature, $T_{GC}$, of refrigerant leaving the heat rejecting heat exchanger is initially measured. This may, e.g., be done by means of a temperature sensor arranged in the refrigerant path at the outlet of the heat rejecting heat exchanger.

Next, a pressure reference, $P_{GC,Ref}$, is calculated, based on the measured temperature, $T_{GC}$. To this end a calculation formula is used, which is applicable to the subcritical control regime as well as to the supercritical control regime. It is an advantage that the same calculation formula is used for both control regimes, because it is thereby not necessary to keep track of whether the vapour compression system is in the subcritical or the supercritical control regime. The calculation of the pressure reference is always done using one and the same calculation formula, and controlling the vapour compression system is therefore very simple.

Finally, an opening degree of the controllable valve is controlled in order to obtain a pressure of refrigerant leaving the heat rejecting heat exchanger which is equal to the calculated pressure reference, $P_{GC,Ref}$.

The method may further comprise the step of measuring a pressure, $P_{GC}$, of refrigerant leaving the heat rejecting heat exchanger, and the step of controlling an opening degree of the controllable valve may comprise comparing the measured pressure, $P_{GC}$, to the calculated pressure reference, $P_{GC,Ref}$. According to this embodiment, the opening degree of the controllable valve is controlled in accordance with a feedback control strategy.

The step of calculating may be performed using the calculation formula:

$$P_{GC,Ref}=P_{Sat}(T_{GC}+\Delta T)+(T_{GC}-T^*+\sqrt{(T_{GC}-T^*)^2+\alpha^2})\cdot\beta,$$

wherein $P_{Sat}$ represents a saturation pressure in the subcritical control regime, extrapolated into the supercritical control regime, $\Delta T$ is a desired subcooling of refrigerant leaving the heat rejecting heat exchanger in the subcritical control regime, $T^*$ is a transition temperature indicating a transition between a subcritical control regime and a supercritical control regime, and $\alpha$ and $\beta$ are constants.

According to this embodiment, the calculation formula may be constructed in the following manner. Initially, a saturation curve for the subcritical region is drawn in a diagram with temperature along the first axis and pressure along the second axis. In the case that the refrigerant is an azeotropic fluid, i.e. a fluid in which the dew line and the bubble line coincide, the common dew line and bubble line is selected as the saturation curve. In the case that the refrigerant is a zeotropic fluid, i.e. a fluid in which the dew line is distinct from the bubble line, the bubble line is selected as the saturation curve. The saturation curve is then extrapolated into the supercritical region. Next, the extrapolated saturation curve is shifted towards lower temperature values, i.e. a constant temperature value is subtracted from every point of the curve. The constant temperature value is selected in such a manner that it corresponds to a desired subcooling of refrigerant leaving the heat rejecting heat exchanger when the vapour compression system is operated in the subcritical region. This ensures that the vapour compression system can be operated with a desired subcooling in the subcritical region.

Next, the part of the curve which is arranged at higher temperature than a transition temperature, $T^*$, is 'swung' or 'rotated' about the transition temperature point in a direction towards lower temperature. How much the curve is 'rotated' is determined by the constant $\beta$. The constant $\beta$ can be selected for the individual system in such a manner that relevant optimisation criteria are met in each case. Thus, $\beta$ should not be regarded as a global constant, but rather as a parameter which is selected for the specific case. It may be constant for a given vapour compression system, but it may also be changed periodically for a given vapour compression system, e.g. in accordance with the amount of heat being recovered. 'Rotating' the curve ensures that an optimal control of the vapour compression system is also obtained in the supercritical control regime.

The constant a can be selected in such a manner that the transition between the 'rotated' part of the curve and the 'non-rotated' part of the curve is smoothed, thereby ensuring a smooth transition between the subcritical control regime and the supercritical control regime.

The step of calculating may further comprise the step of deriving the transition temperature, $T^*$, on the basis of a preselected transition pressure, $P^*$, and a desired subcooling value, $\Delta T$. According to this embodiment, a desired transition pressure, $P^*$, is selected. $P^*$ may advantageously be slightly lower than the critical pressure of the refrigerant flowing in the vapour compression system. In the case that the refrigerant is $CO_2$, the transition pressure, $P^*$, may advantageously be approximately 67 bar. The transition temperature, $T^*$, is then derived by means of the shifted curve, as the temperature which corresponds to the selected transition pressure, $P^*$.

In a similar manner, the constant $\beta$ may be selected in the following manner. A suitable point above the transition point, representing a suitable combination of pressure and temperature is selected. Then $\beta$ is selected or calculated in such a manner that the 'rotated' part of the curve passes through the selected point.

As an alternative to the calculation formula described above, the pressure reference may be calculated using a suitable fitting technique, e.g. applying a polynomial fit, such as a high order polynomial fit.

According to a second aspect the invention provides a control system for controlling operation of a vapour compression system, the control system being capable of performing the method steps of the method according to the first aspect of the invention.

According to a second aspect the invention provides a vapour compression system comprising a compressor, a heat rejecting heat exchanger, a controllable valve, a receiver, at least one expansion device and at least one evaporator arranged along a refrigerant path having refrigerant flowing therein, the vapour compression system further comprising a control system according to the second aspect of the invention. Since the control system according to the second aspect of the invention is capable of performing the method steps of the method according to the first aspect of the invention, the vapour compression system according to the third aspect of the invention is controlled in accordance with the first aspect of the invention. The remarks set forth above are therefore equally applicable here.

The heat rejecting heat exchanger may be arranged to operate as a condenser when the vapour compression system is operated in a subcritical control regime, and the heat rejecting heat exchanger may be arranged to operate as a gas cooler when the vapour compression system is operated in a supercritical control regime.

The controllable valve may be an expansion valve. According to this embodiment, the refrigerant flowing from the heat rejecting heat exchanger to the receiver, via the controllable valve, is expanded.

The vapour compression system may be a refrigeration system, an air condition system, a heat pump, or any other suitable kind of vapour compression system.

The refrigerant flowing in the refrigerant path may be $CO_2$. $CO_2$ is often used in supercritical vapour compression systems or vapour compression systems which are capable of operating in a subcritical as well as a supercritical control regime, and it is therefore very suitable for this purpose. As an alternative, any other suitable supercritical refrigerants may be used.

BRIEF DESCRIPTION OF THE DRAWINGS

The invention will now be described in further detail with reference to the accompanying drawings in which.

DETAILED DESCRIPTION

Figure 1:
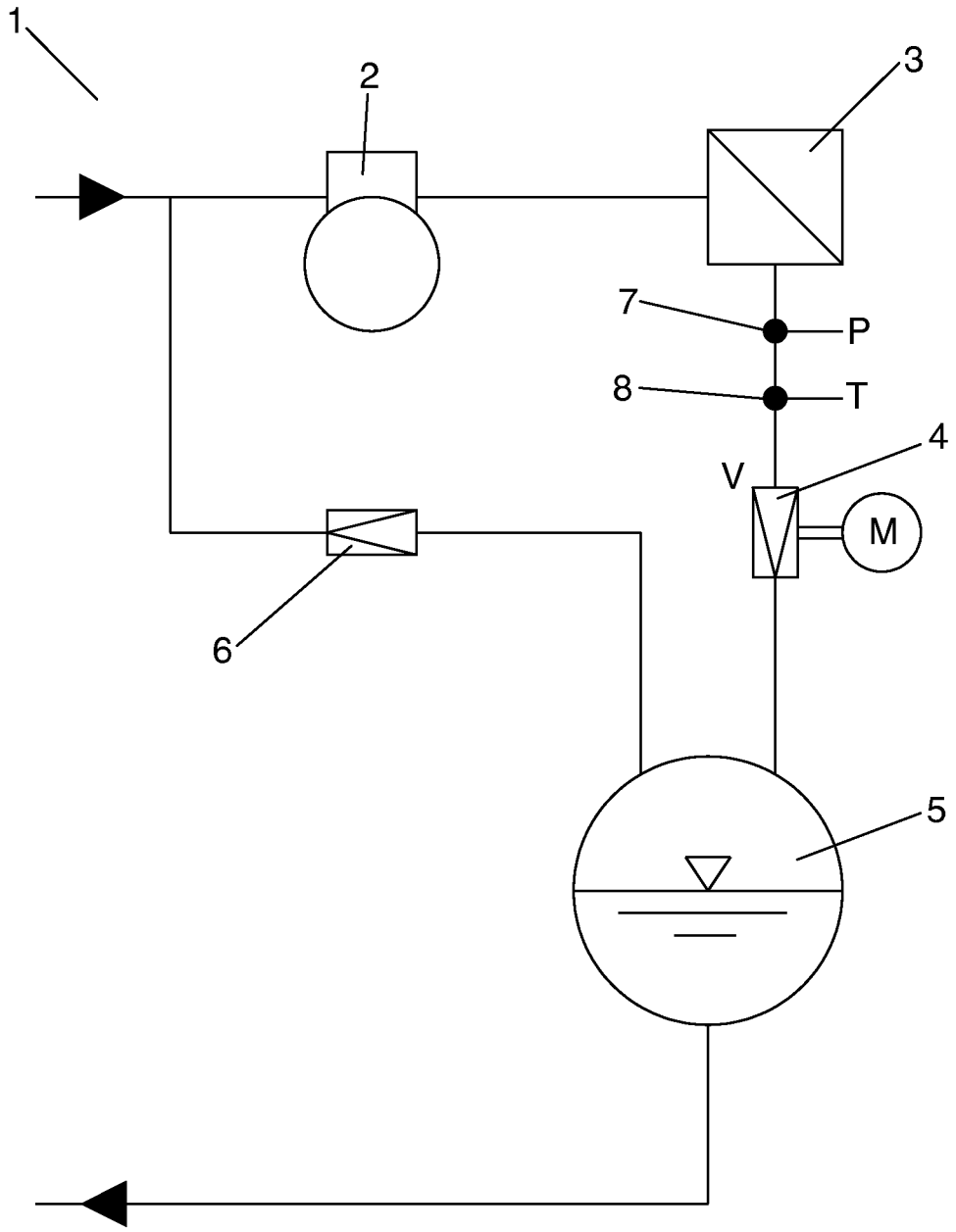
FIG. 1 is a diagrammatic view of a part of a vapour compression system according to an embodiment of the invention.

FIG. 1 is a diagrammatic view of part of a vapour compression system 1 according to an embodiment of the invention. The vapour compression system 1 comprises a compressor 2, a heat rejecting heat exchanger 3, a controllable valve 4 and a receiver 5, all being fluidly interconnected in a refrigerant path. The opening degree of the controllable valve 4 determines the pressure of refrigerant leaving the heat rejecting heat exchanger and entering the controllable valve 4. The vapour compression system 1 is of a kind which is capable of being operated in a subcritical control regime as well as in a supercritical control regime. Thus, the refrigerant flowing in the refrigerant path is of a kind which is suitable for operating in a subcritical region as well as in a supercritical region.

The vapour compression system 1 further comprises at least one expansion device, e.g. in the form of an expansion valve, and at least one evaporator. These components are also arranged in the refrigerant path, but are not shown in FIG. 1. Accordingly, in FIG. 1 only the high pressure side of the vapour compression system 1 is shown, and it should be noted that the low pressure side of the vapour compression system, including the expansion device(s) and the evaporator(s), may be designed in any suitable manner.

The vapour compression system 1 of FIG. 1 is preferably operated in the following manner. The refrigerant is compressed in the compressor 2, and the compressed refrigerant is supplied to the heat rejecting heat exchanger 3. In the case that the vapour compression system 1 is operated in a subcritical control regime, the heat rejecting heat exchanger 3 operates as a condenser, i.e. at least part of the refrigerant undergoes a phase transition when passing through the heat rejecting heat exchanger 3. Thus, in this case the refrigerant leaving the heat rejecting heat exchanger 3 is at least partly in a liquid phase. On the other hand, in the case that the vapour compression system 1 is operated in a supercritical control regime, the heat rejecting heat exchanger 3 operates as a gas cooler, i.e. the refrigerant passing the heat rejecting heat exchanger 3 does not undergo a phase transition. Thus, in this case the refrigerant leaving the heat rejecting heat exchanger 3 is in a substantially gaseous phase.

The refrigerant is further passed on to the receiver 5, via the controllable valve 4. In the receiver 5 the liquid refrigerant is separated from the gaseous refrigerant. The liquid refrigerant is passed on towards the low pressure side (not shown) of the vapour compression system 1. The gaseous part of the refrigerant is supplied to the compressor 2 via a valve 6. Refrigerant returning from the low pressure side of the vapour compression system 1 is also supplied to the compressor 2.

A pressure sensor 7 and a temperature sensor 8 are arranged in the refrigerant path between the heat rejecting heat exchanger 3 and the controllable valve 4. The pressure sensor 7 and the temperature sensor 8 measure the pressure and the temperature, respectively, of the refrigerant flowing in this part of the refrigerant path. A pressure reference, $P_{GC,Ref}$, is calculated on the basis of the temperature, $T_{GC}$, measured by means of the temperature sensor 8. This is done using a calculation formula which is applicable to the subcritical control regime as well as to the supercritical control regime. Thus, it is not necessary to investigate whether the vapour compression system 1 is in the subcritical or supercritical control regime in order to be able to perform the calculation.

The pressure, $P_{GC}$, measured by means of the pressure sensor 7 is compared to the calculated pressure reference, $P_{GC,Ref}$. Based on this comparison, the opening degree of the controllable valve 4 is controlled in order to obtain that the measured pressure, $P_{GC}$, is equal to the calculated pressure reference, $P_{GC,Ref}$, i.e. that a desired pressure of the refrigerant leaving the heat rejecting heat exchanger 3 is obtained.

Figure 2:
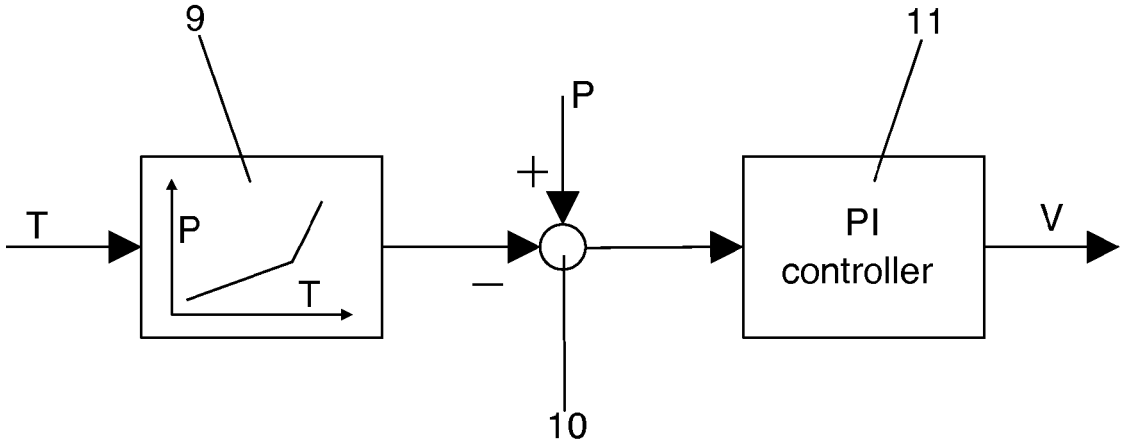
FIG. 2 is a block diagram illustrating a control method according to an embodiment of the invention.

FIG. 2 is a block diagram illustrating a control method according to an embodiment of the invention. The control method illustrated by the block diagram of FIG. 2 could, e.g., be used for controlling the vapour compression system 1 of FIG. 1. A measured refrigerant temperature, T, is supplied to a calculation module 9. Based on the measured temperature, T, and a predefined calculation formula, a pressure reference is calculated and supplied to a comparator 10. In the comparator 10 the calculated pressure reference is compared to a measured refrigerant pressure, P. The result of the comparison is supplied to a proportional integral (PI) controller 11 which in turn supplies a control signal for a controllable valve, V. The control signal controls the opening degree of the valve in accordance with a proportional integral (PI) control strategy, and in order to obtain a measured refrigerant pressure, P, which is equal to the calculated pressure reference.

The measured refrigerant temperature could, e.g., be the temperature, $T_{GC}$, measured by means of the temperature sensor 8 of FIG. 1. Similarly, the measured refrigerant pressure could, e.g., be the pressure, $P_{GC}$, measured by means of the pressure sensor 7 of FIG. 1. Similarly, the controllable valve could be the controllable valve 4 of FIG. 1.

It should be noted that even though the controller 11 illustrated in FIG. 2 is a proportional integral (PI) controller, the skilled person would understand that other suitable kinds of controllers could alternatively be used.

FIG. 3 shows three graphs illustrating calculation of pressure reference in a method according to an embodiment of the invention. All three graphs show pressure as a function of temperature.

Figure 3C:
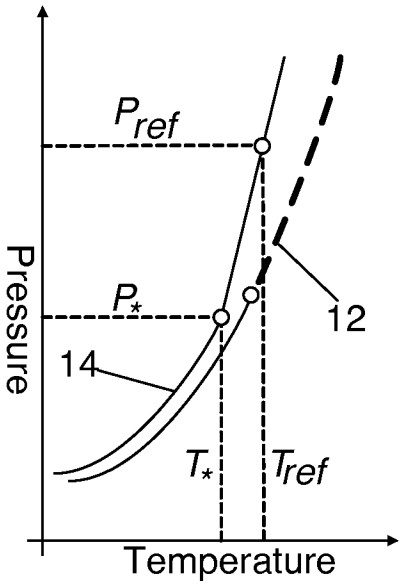
FIGS. 3A, 3B and 3C show three graphs illustrating calculation of pressure reference in a method according to an embodiment of the invention.
Figure 3B:
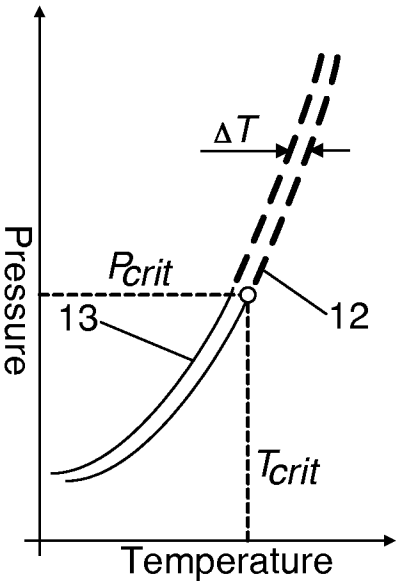
Figure 3A:
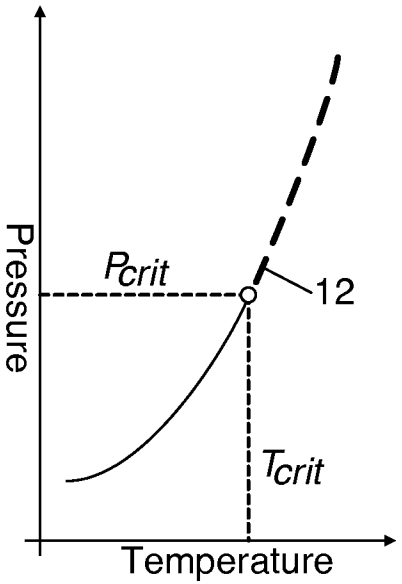

In FIG. 3*a* a saturation line for the refrigerant is shown as a solid line in a subcritical region, i.e. at pressure values and temperature values which are below the critical point. The saturation line is extrapolated into the supercritical region, i.e. at pressure values and temperature values above the critical point. Thus, the graph 12 shown in FIG. 3*a* is an extrapolated saturation line.

In FIG. 3*b* the extrapolated saturation line 12 of FIG. 3*a* is also shown. Furthermore, a shifted saturation line 13 is shown. The shifted saturation line 13 is simply the extrapolated saturation line 12 shifted by an amount ΔT towards lower temperature, i.e. parallel to the temperature axis.

In FIG. 3*c* the extrapolated saturation line 12 of FIG. 3*a* is also shown. Furthermore, a manipulated shifted line 14 is shown. The lower part of the manipulated shifted line 14, up to a transition point at temperature T*, and pressure P*, is identical to the shifted saturation line 13 of FIG. 3*b*. The transition point is selected in such a manner that the transition temperature, T*, and the transition pressure, P*, are slightly lower than the critical temperature and pressure, respectively. This ensures that the vapour compression system is not operated at temperatures and pressures which are too close to the critical point.

The upper part of the shifted saturation line 13, i.e. the part above the transition point, has been 'swung' or 'rotated' about the transition point in a direction towards lower temperatures, in order to obtain the manipulated shifted saturation line 14.

When a pressure reference is to be calculated on the basis of a measured temperature, the pressure value corresponding to the measured temperature in accordance with the manipulated shifted saturation line is found, as indicated in FIG. 3*c*. This pressure value is the pressure reference.

Figure 4:
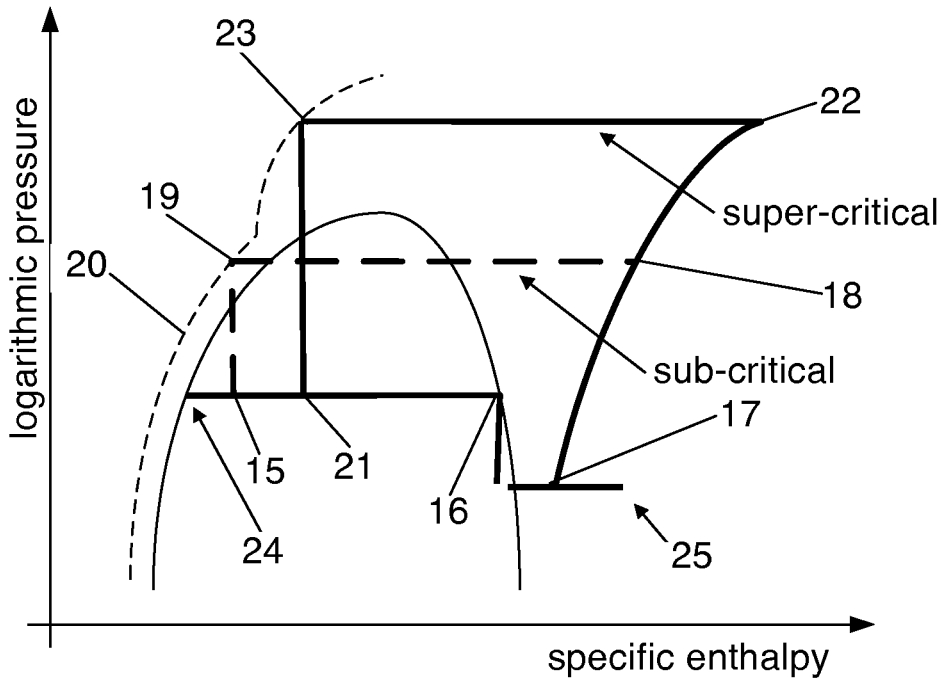
FIG. 4 is a pressure-enthalpy (log(p)-h) diagram, illustrating variations in pressure and enthalpy of the refrigerant during operation of a vapour compression system in accordance with an embodiment of the invention, and during a subcritical and a supercritical control regime.

FIG. 4 is a pressure-enthalpy (log(p)-h) diagram, illustrating variations in pressure and enthalpy of the refrigerant during operation of a vapour compression system in accordance with an embodiment of the invention, and during a subcritical and a supercritical control regime.

In a subcritical control regime, the refrigerant enters a receiver, partially in liquid phase and partially in vapour phase at point 15. The vapour fraction, at point 16, is led back into a compressor via a valve. The liquid fraction, at point 24, is typically expanded further in an expansion device before being evaporated, and this fraction returns as superheated vapour, at point 25. Before entering the compressor the vapour, possibly with a small amount of liquid in it, from the valve and the entering superheated gas are mixed without change in pressure at point 17.

From point 17 to point 18 the refrigerant is compressed in a compressor. The pressure as well as the enthalpy increases during this step.

From point 18 to point 19 the refrigerant passes through a heat rejecting heat exchanger. The enthalpy decreases during this step, while the pressure is constant. Since the refrigeration cycle is in the subcritical region, the refrigerant is condensed during this step, i.e. the refrigerant undergoes a phase transition, and the refrigerant leaving the heat rejecting heat exchanger is at least partly in a liquid phase. The dashed line 20 represents the calculation formula which was derived during the process illustrated in FIG. 3. It can be seen that the vapour compression system is controlled in such a manner that the refrigerant leaving the heat rejecting heat exchanger has a subcooling which is given by the calculation formula.

From point 19 to point 15 the refrigerant is expanded in an expansion device before once again being supplied to the receiver. The enthalpy is constant, while the pressure decreases during this step.

In a supercritical control regime the liquid part of the refrigerant passes through the expansion device and the evaporator from point 24 to point 25, essentially as described above. From point 17 to point 22 the refrigerant is compressed in the compressor. It can be seen that the enthalpy as well as the pressure increases more during this step than it was the case in the subcritical control regime.

From point 22 to point 23 the refrigerant passes through the heat rejecting heat exchanger. The enthalpy is decreased while the pressure remains constant during this step. Since the refrigeration cycle is in the supercritical region, the refrigerant remains in a substantially gaseous phase during this step, i.e. the heat rejecting heat exchanger operates as a gas cooler, and the refrigerant leaving the heat rejecting heat exchanger is in a substantially gaseous phase. It can be seen that the enthalpy of the refrigerant leaving the heat rejecting heat exchanger is determined by the dashed line 20, and is thereby defined by the calculation formula which the dashed line 20 represents.

From point 23 to point 21 the refrigerant is expanded in the expansion device before once again being supplied to the receiver. The enthalpy is constant, while the pressure decreases during this step.

It should be noted that whenever the term 'constant' is used in the description above, it should be interpreted to cover situations in which the enthalpy or pressure is actually constant, as well as situations in which the enthalpy or pressure is approximately constant.

Although various embodiments of the present invention have been described and shown, the invention is not restricted thereto, but may also be embodied in other ways within the scope of the subject-matter defined in the following claims.

What is claimed is:

1. A method for controlling operation of a vapour compression system, the vapour compression system comprising a compressor, a heat rejecting heat exchanger, a controllable valve, a receiver, at least one expansion device and at least one evaporator arranged along a refrigerant path having refrigerant flowing therein, the vapour compression system being capable of being operated in a subcritical control regime as well as in a supercritical control regime, the method comprising the steps of:

measuring a temperature, $T_{GC}$, of refrigerant leaving the heat rejecting heat exchanger, calculating a pressure reference, $P_{GC,\ Ref}$, based on the measured temperature, $T_{GC}$, and using a calculation formula being applicable to the subcritical control regime as well as to the supercritical control regime, and controlling an opening degree of the controllable valve and obtaining a pressure of refrigerant leaving the heat rejecting heat exchanger which is equal to the calculated pressure reference, $P_{GC,\,Ref}$, wherein the step of calculating is performed using the calculation formula:

wherein $P_{sat}$ represents a saturation pressure in the subcritical control regime, extrapolated into the supercritical control regime, $\Delta T$ is a desired subcooling of refrigerant leaving the heat rejecting heat exchanger in the subcritical control regime, T* is a transition temperature indicating a transition between a subcritical control regime and a supercritical control regime, and $\alpha$ and $\beta$ are constants.

2. The method according to claim 1, further comprising the step of measuring a pressure, $P_{GC}$, of refrigerant leaving the heat rejecting heat exchanger, and wherein the step of controlling an opening degree of the controllable valve comprises comparing the measured pressure, $P_{GC}$, to the calculated pressure reference, $P_{GC,Ref}$.

3. The method according to claim 1, wherein the step of calculating further comprises the step of deriving the transition temperature, T*, on the basis of a preselected transition pressure, P*, and said desired sub-cooling value, $\Delta T$.

4. A control system for controlling operation of a vapour compression system, the control system being capable of performing the method steps of the method according to claim 1.

5. A vapour compression system comprising a compressor, a heat rejecting heat exchanger, a controllable valve , a receiver, at least one expansion device and at least one evaporator arranged along a refrigerant path having refrigerant flowing therein, the vapour compression system further comprising a control system according to claim 4.

6. The vapour compression system according to claim 5, wherein the heat rejecting heat exchanger is arranged to operate as a condenser when the vapour compression system is operated in a subcritical control regime, and the heat rejecting heat exchanger is arranged to operate as a gas cooler when the vapour compression system is operated in a supercritical control regime.

7. The vapour compression system according to claim 5, wherein the controllable valve is an expansion valve.

8. The vapour compression system according to claim 5, wherein the vapour compression system is a refrigeration system.

9. The vapour compression system according to claim 5, wherein the refrigerant flowing in the refrigerant path is $CO_2$.

10. A control system for controlling operation of a vapour compression system, the control system being capable of performing the method steps of the method according to claim 2.

11. A control system for controlling operation of a vapour compression system, the control system being capable of performing the method steps of the method according to claim 1.

12. A control system for controlling operation of a vapour compression system, the control system being capable of performing the method steps of the method according to claim 3.

13. The vapour compression system according to claim 6, wherein the controllable valve is an expansion valve.

14. The vapour compression system according to claim 6, wherein the vapour compression system is a refrigeration system.

15. The vapour compression system according to claim 7, wherein the vapour compression system is a refrigeration system.

16. The vapour compression system according to claim 6, wherein the refrigerant flowing in the refrigerant path is $CO_2$.

17. The vapour compression system according to claim 7, wherein the refrigerant flowing in the refrigerant path is $CO_2$.

18. The vapour compression system according to claim 8, wherein the refrigerant flowing in the refrigerant path is $CO_2$.

* * * * *